US010931008B2

(12) United States Patent
Qiu

(10) Patent No.: US 10,931,008 B2
(45) Date of Patent: Feb. 23, 2021

(54) ANTENNA MODULE AND MOBILE TERMINAL

(71) Applicant: AAC Technologies Pte. Ltd., Singapore (SG)

(72) Inventor: Xiaojun Qiu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 91 days.

(21) Appl. No.: 16/524,074

(22) Filed: Jul. 28, 2019

(65) Prior Publication Data

US 2020/0058993 A1 Feb. 20, 2020

(30) Foreign Application Priority Data

Aug. 20, 2018 (CN) ..... 201810946067.2

(51) Int. Cl.

| | |
|---|---|
| ***H01Q 5/30*** | (2015.01) |
| ***H01Q 5/20*** | (2015.01) |
| ***H01Q 1/52*** | (2006.01) |
| ***H01Q 1/24*** | (2006.01) |

(52) U.S. Cl.
CPC ..... *H01Q 1/523* (2013.01); *H01Q 1/243* (2013.01); *H01Q 5/20* (2015.01); *H01Q 5/30* (2015.01)

(58) Field of Classification Search
None
See application file for complete search history.

(56) References Cited

U.S. PATENT DOCUMENTS

2018/0034148 A1* 2/2018 Nam ..... H01Q 1/243

* cited by examiner

*Primary Examiner* — Henry Luong
(74) *Attorney, Agent, or Firm* — W&G Law Group LLP

(57) ABSTRACT

An antenna module including a first antenna and a second antenna close to the first antenna. The second antenna includes an isolation circuit and a second tuning switch controlling an access state of the isolation circuit. The second tuning switch includes two modes. When the second tuning switch is in a first mode, the isolation circuit accesses to a feeding network of the second antenna. When the second tuning switch is in a second mode, the isolation circuit does not access to the feeding network of the second antenna. Isolation of the first antenna and the second antenna in a preset band in the first mode is superior to that in the second mode.

10 Claims, 11 Drawing Sheets

I Reflection Coefficient of First Antenna
II Reflection Coefficient of Second Antenna
III Isolation between First Antenna and Second Antenna I Reflection Coefficient of First Antenna
II Reflection Coefficient of Second Antenna
III Isolation between First Antenna and Second Antenna

ANTENNA MODULE AND MOBILE TERMINAL

TECHNICAL FIELD

The present disclosure relates to the field of communication technologies, and in particular, to an antenna module and a mobile terminal.

BACKGROUND

With the development of mobile communication technology, mobile phones, PADs, and laptop computers have gradually become indispensable electronic products in life, and such electronic products are additionally provided with an antenna module so as to become electronic communication products with communication functions.

The fifth-generation mobile communication is drawing near. In order to increase a transmission rate and achieve higher transmission data capacity, mobile communication terminals will support more MIMO antenna transceiver systems for mobile phones, which also means that the number of antennas of mobile phones is increasing. However, space of the mobile phone is limited, and it is necessary to satisfy so many antennas at the same time, so that a distance between antennas is getting closer and closer, and isolation is a very difficult problem.

Therefore, it is indeed necessary to provide an improved antenna module to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

Figure 1:
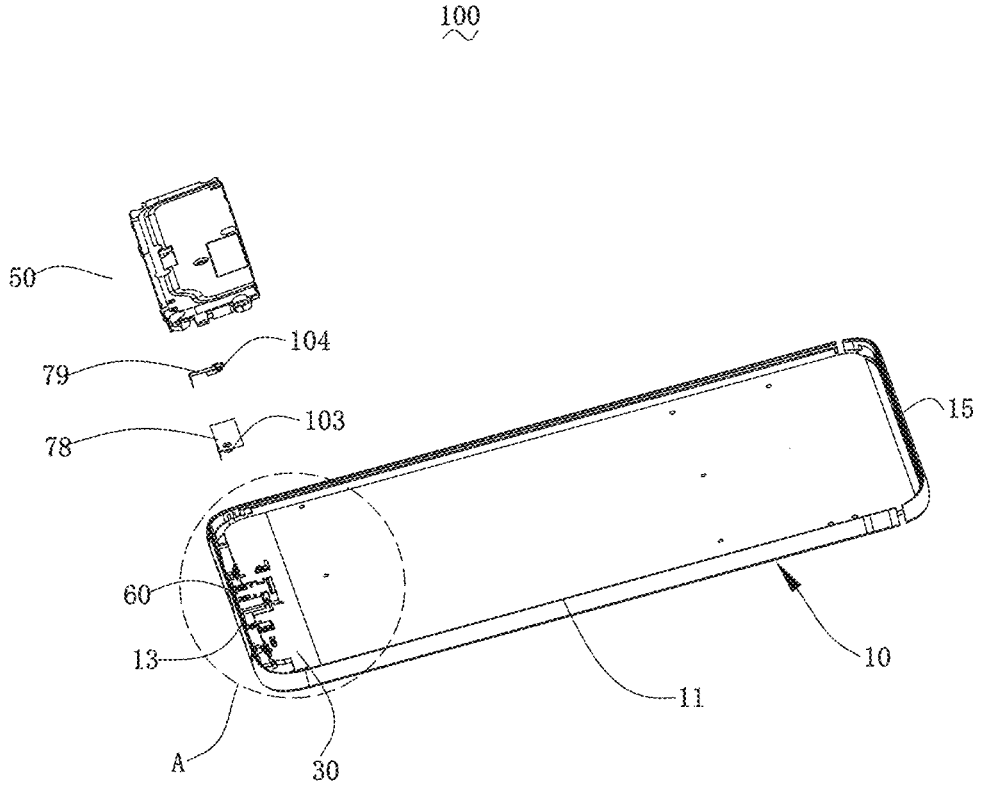
FIG. 1 is a partial exploded perspective structural schematic diagram of a preferred embodiment of a mobile terminal of the present disclosure.
Figure 2:
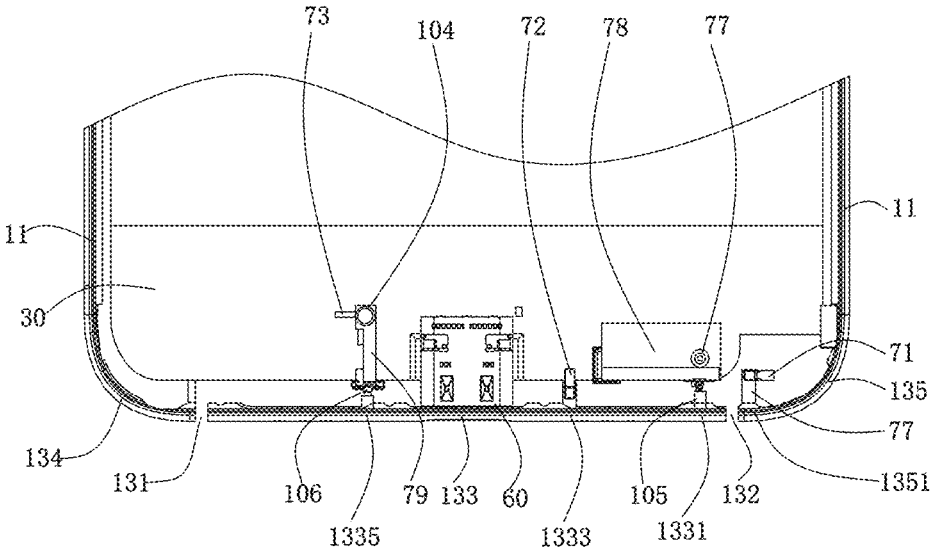
FIG. 2 is a partial structural schematic diagram of the mobile terminal shown in FIG. 1.
Figure 3:
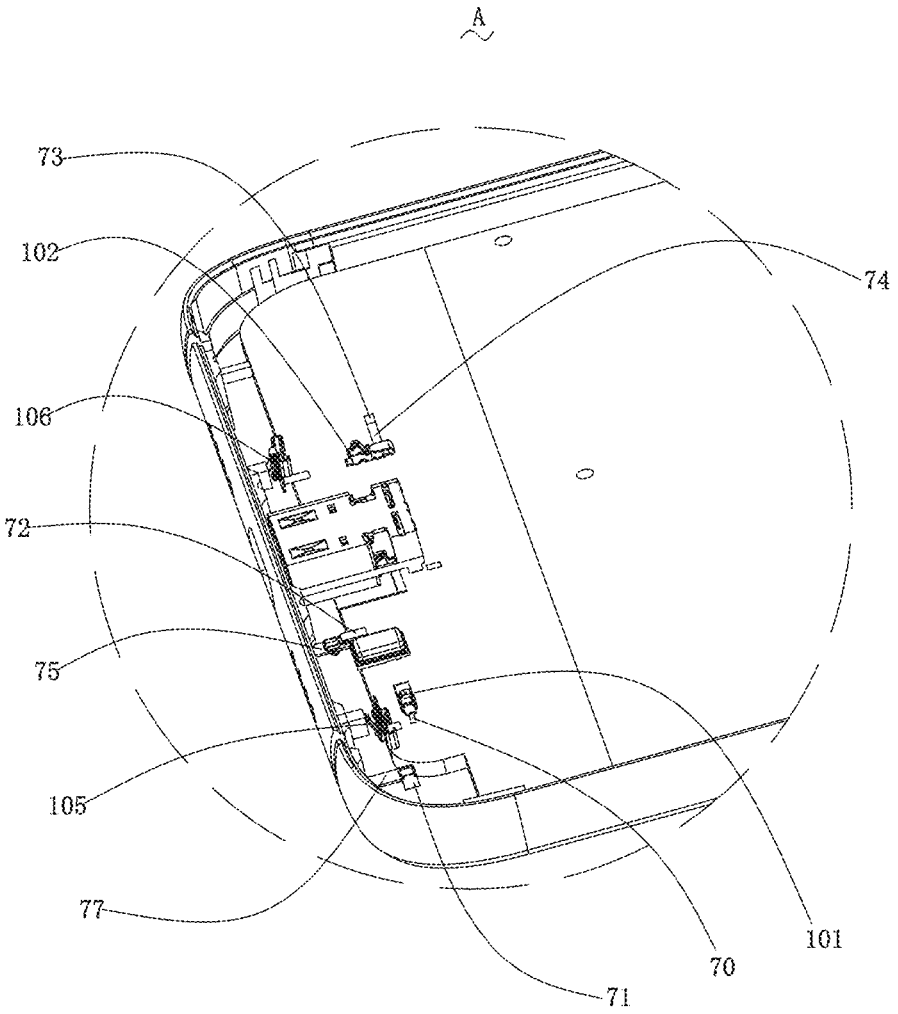
FIG. 3 is an enlarged structural schematic diagram of a portion A shown in FIG. 1.
Figure 4:
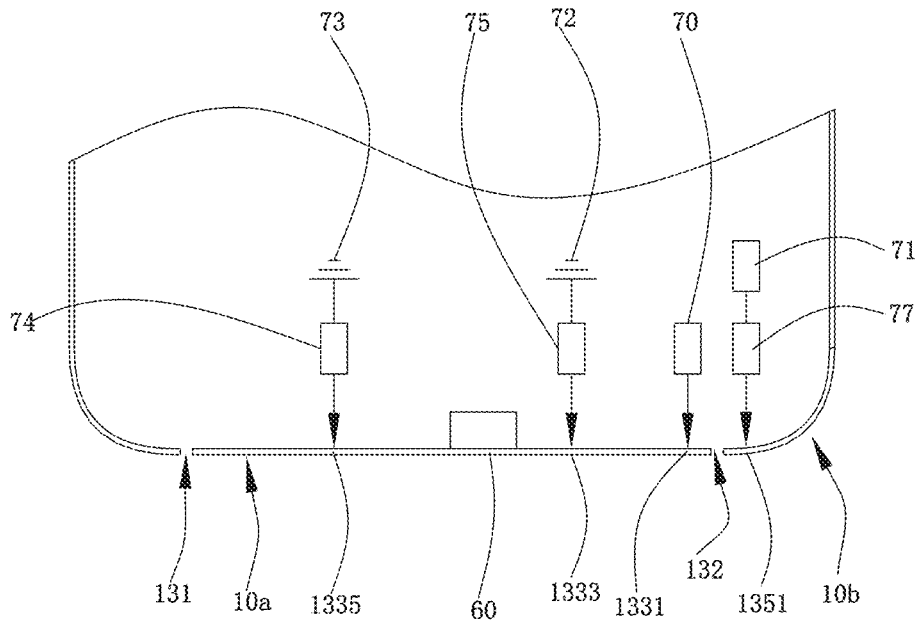
FIG. 4 schematically illustrates a circuit connection structure of a specific embodiment of an antenna module of the mobile terminal shown in FIG. 1.
Figure 5:
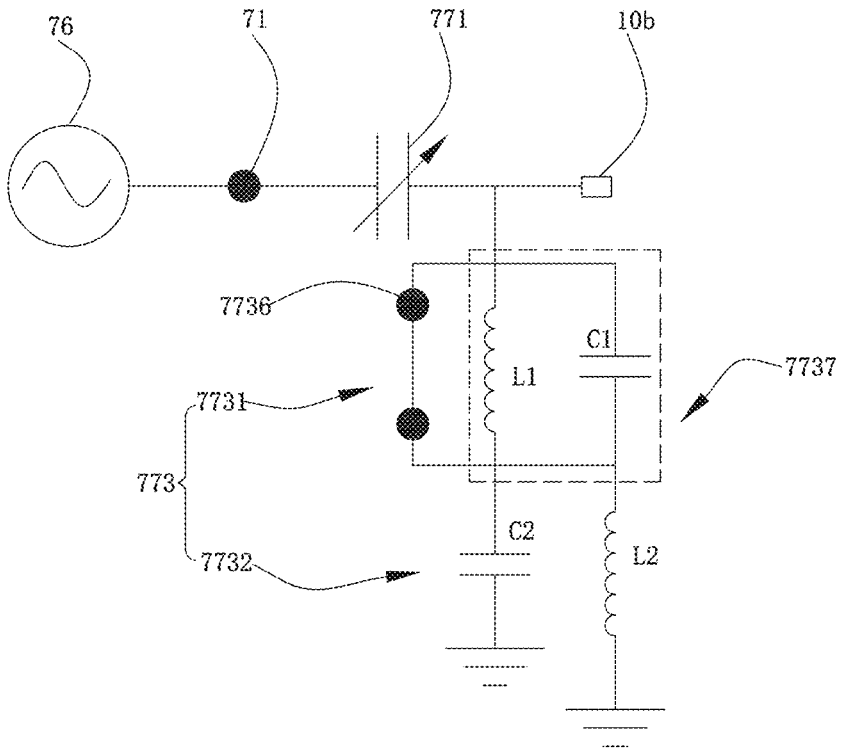
FIG. 5 schematically illustrates a circuit connection structure when a second tuning switch of an antenna module of the mobile terminal shown in FIG. 4 is in a first mode.
Figure 6:
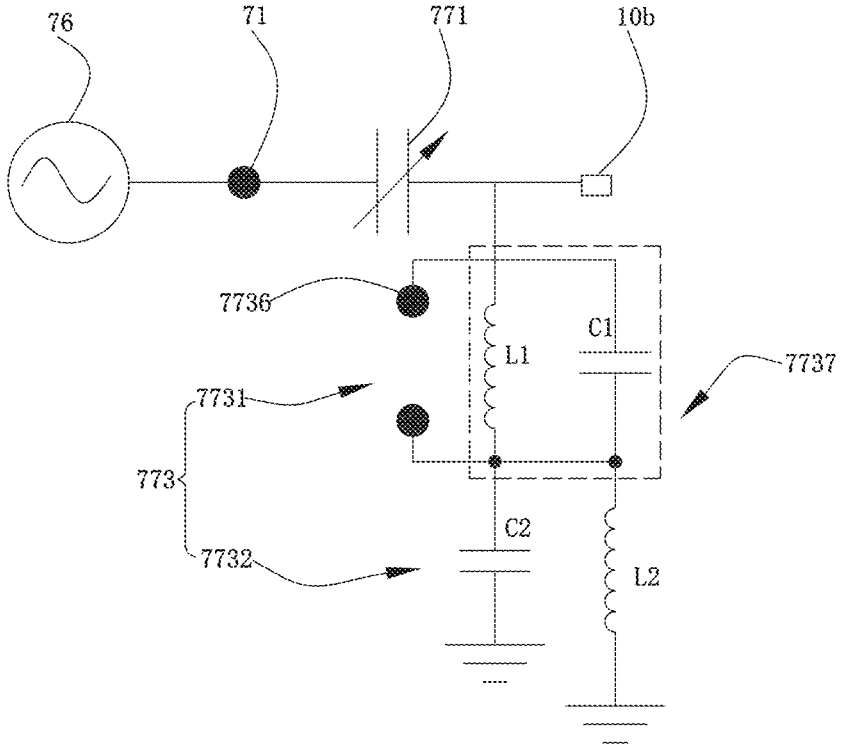
FIG. 6 schematically illustrates a circuit connection structure when a second tuning switch of an antenna module of the mobile terminal shown in FIG. 4 is in a second mode.

The present disclosure will be further illustrated with reference to the accompanying drawings and the embodiments.

As shown in FIG. 1 to FIG. 6, an embodiment of the present disclosure provides a mobile terminal 100, which may be a mobile phone, a tablet computer, a multimedia player, etc. For ease of understanding, the following embodiments will be described by taking a smart mobile phone as an example.

The mobile terminal 100 includes a metal frame 10, a main board 30 received in the metal frame 10, a plastic bracket 50 that is provided on and coving the main board 30, a USB module 60 and an antenna module that are provided on the main board 30. The plastic bracket 50 is provided close to the bottom of the mobile terminal 100.

The metal frame 10 includes two middle frames 11 arranged opposite to each other, a bottom frame 13 and a top frame 15 that are respectively provided at two ends of the middle frame 11 and connected to the middle frame 11 respectively. The top frame 15, one of the middle frames 11, the bottom frame 13 and the other one of the middle frames 11 are sequentially connected to form the metal frame 10.

The bottom frame 13 is provided with a first slit 131 and a second slit 132. The first slit 131 and the second slit 132 divide the bottom frame 13 into a main frame 133 located in the middle, and a left-side connecting frame 134 and a right-side connecting frame 135 that are provided on two sides of the main frame 133. Two ends of the left-side connecting frame 134 are respectively connected to the first slit 131 and one of the middle frames 11. Two ends of the right-side connecting frame 135 are respectively connected to the second slit 132 and the other one of the middle frames 11. Specifically, the left-side connecting frame 134 and the right-side connecting frame 135 are symmetrically provided about a central axis of the mobile terminal in a width direction, such that the left-side connecting frame 134 and the right-side connecting frame 135 can be considered as arc-shaped corners connecting the main frame 133 with the middle frames 11, wherein the left-side connecting frame 134 is a left-side corner and the right-side connecting frame 135 is a right-side corner.

The antenna module includes a first feeding point 70, a second feeding point 71, a first ground point 72, a second ground point 73, and a first variable capacitor (Tunner1) 74, a first tuning switch (SW1) 75, a radio frequency feeding source 76 and a feeding network 77 that are provided on the main board 30, and a first antenna unit 78 and a second antenna unit 79 that are provided on a surface of the plastic bracket 50 facing away from the main board 30. The first antenna unit 78 and the second antenna unit 79 are formed on a surface of the plastic bracket 50 facing away from the main board 30 by an LDS process using laser.

The first radiation portion 10*a* includes a main frame 133, a first antenna unit 78, and a second antenna unit 79. One end of the first antenna unit 78 is connected to the first feeding point 70 and the other end thereof is connected to the main frame 133. The main frame 133 is connected to the first ground point 72 through the first tuning switch 75. One end of the second antenna unit 79 is connected to the main frame 133 and the other end thereof is connected to the second ground point 73 through the first variable capacitor 74, so as to form a first antenna. The first antenna is of an IFA antenna type. The first variable capacitor 74 is a key component for frequency expanding of the first antenna, and with help of the different access states of the first tuning switch 75 and the change in capacitance value itself, an LTE low frequency of 698-960 MHz and an LTE medium-high frequency of 1710-2690 MHz can be covered.

The second radiation portion 10*b* is a right-side connecting frame 135, and the second radiation portion 10*b* is grounded through the middle frame 11 connected thereto. Specifically, the middle frame 11 is grounded by being connected to the metal middle frame of the mobile terminal 100. The RF feeding source 76 is connected to the second feeding point 71. The second feeding point 71 is connected to the second radiation portion 10*b* through the feeding network 77, so as to form a second antenna. The second radiation portion 10*b* is directly connected to the middle frame 11 to form an antenna design of a "loop antenna". The operating bands covered by the second radiation portion 10*b* are bands of n78 (3300-3380 MHz) and n79 (4800-5000 MHz) which are proposed by the current fifth generation mobile communication, and a new TDD-LTE band of B46 (5150-5925 MHz) is also supported.

The first feeding point 70 is connected at a first position 1331 of the main frame 133. The second feeding point 71 is connected at a second position 1351 of the right-side connecting frame 135. The first ground point 72 is connected at a third position 1333 of the main frame 133. The second ground point 73 is connected at a fourth position 1335 of the main frame 133. The first position 1331 and the second position 1351 are provided on two sides of the second slit 132 and provided close to the second slit 132. The third position 1333 and the fourth position 1335 are provided on two sides of the USB module 60, and the third position 1333 is located between the USB module 60 and the first position 1331.

In the present embodiment, the first feeding point 70 and the second ground point 73 are provided on a surface of the printed circuit board 30 facing towards the plastic bracket 50. The first ground point 72 and the second feeding point 71 are provided on a surface of the printed circuit board 30 facing away from the plastic bracket 50.

Preferably, the antenna module further includes a first spring pin 101 that is provided on a surface of the printed circuit board 30 facing towards the plastic bracket 50 and connected to the first feeding point 70, a second spring pin 102 connected to the first variable capacitor 74, a first connecting portion 103 having one end connected to the first antenna unit 78 and the other end connected to the first spring pin 101, and a second connecting portion 104 having one end connected to the second spring pin 102 and the other end connected to the second antenna unit 79.

Preferably, the antenna module further includes a third spring pin 105 and a fourth spring pin 106 that abut against the main frame 131. The third spring pin 105 has one end connected to the main frame 131 and the other end connected to the first antenna unit 78. The fourth spring pin 106 has one end connected to the main frame 131 and the other end connected to the second antenna unit 79.

In the present embodiment, the first tuning switch 75 is provided with a third inductor access state, a fourth inductor access state, a fifth inductor access state, and an open-circuit state. Specifically, when the first tuning switch 75 is in the third inductor access state, the first radiation portion 10*a* is connected to the first ground point 72 through a third inductor; when the first tuning switch 75 is in the fourth inductor access state, the first radiation portion 10*a* is connected to the first ground point 72 through a fourth inductor; when the first tuning switch 75 is in the fifth inductor access state, the first radiation portion 10*a* is connected to the first ground point 72 through the fifth inductor; when the first tuning switch 75 is in an open-circuit state, the first radiation portion 10*a* is electrically isolated from the first ground point 72. The values of the third inductor, the fourth inductor, and the fifth inductor are 3 nH, 4.3 nH, and 6.2 nH, respectively.

The feeding network 77 includes a second variable capacitor (Tunner 2) 771 and a matching network 773. The matching network 773 includes a first branch 7731 and a second branch 7732 that are connected in series. A first end of the second variable capacitor 771 is connected to the second feeding point 71. A second end of the second variable capacitor 771 is respectively connected to a first end of the first branch 7731 and the second radiation portion 10*b*. A second end of the first branch 7731 is grounded through the second branch 7732.

The first branch 7731 includes a second tuning switch (SW2) 7736 having an open-circuit state (open) and a short-circuit state (on), and an isolation circuit 7737 connected in parallel to the second tuning switch 7736. The second tuning switch 7736 is used to control whether the isolation circuit 7737 accesses to the feeding network 77. Specifically, the second tuning switch 7736 includes a first mode and a second mode, wherein the first mode corresponds to the open-circuit state of the second tuning switch 7736 and the second mode corresponds to the short-circuit state of the second tuning switch 7736. When the second tuning switch 7736 is in the first mode, the isolation circuit 7735 accesses to the feeding network 77; when the second tuning switch 7736 is in the second mode, the isolation circuit 7735 is turned into the short-circuit state by the second tuning switch 7736 and doesn't access to the feeding network. Moreover, when in the first mode and the second mode, the second variable capacitor 771 accesses to the feeding network 77 of the second antenna with different capacitance values. Specifically, in the first mode, the second variable capacitor 771 is 4.7 pF, and in the second mode, the second variable capacitor 771 is 8 pF.

In the present embodiment, when in the first mode and the second mode, the first antenna and the second antenna both support 5G bands of 3300-3800 MHz and 4800-5000 MHz, forming a 2×2 MIMO mode. When in the second mode, the first antenna supports the LTE low frequency of 698-960 MHz and the LTE medium-high frequency of 1710-2690 MHz, and can support multi-carrier aggregation. When in the first mode and the second mode, the second antenna further supports TD-LTE new bands of 5150-5925 MHz and 5855-5925 MHz.

The isolation circuit 7737 includes a first capacitor C1 and a first inductor L1 that are connected in parallel to each other. Namely, the second tuning switch 7736, the first capacitor C1, and the first inductor L1 are connected in parallel. The first capacitor C1 is 6.8 pF, and the first inductor L1 is 3.9 nH. The second branch 7732 includes a second capacitor C2 and a second inductor L2 that are connected in parallel to each other. A first end of the second capacitor C2 is connected to the first inductor L1. A second end of the second capacitor C2 is grounded. A first end of the second inductor L2 is connected to the first capacitor C1. A second end of the second inductor L2 is grounded. The second capacitor C2 is 0.4 pF and the second inductor L2 is 12 nH.

When the second tuning switch is in the second mode (On), the second variable capacitor (Tunner2) is 8 pF, such that 8 operating states are switched by adjusting the first variable capacitor (Tunner1) and the first tuning switch (SW1), thereby achieving that the first antenna covers different LTE bands and the second antenna covers the bands of n78, n79 and B46. Referring to the table below for details.

TABLE 1

| State | SW1 | Tunner1 | (SW2&Tunner2) | Coverage Band |
|---|---|---|---|---|
| State 1 | 3 nH | 0.4 pf | On, 8 pf | 910-960 MHz, 3300-3380 MHz (n78), 4800-5000 MHz (n79), 5150-5925 MHz (TDD-LTE B46) |
| State 2 | 3 nH | 0.6 pf | On, 8 pf | 880-930 MHz, 3300-3380 MHz (n78), 4800-5000 MHz (n79), 5150-5925 MHz (TDD-LTE B46) |
| State 3 | 4.3 nH | 0.5 pf | On, 8 pf | 840-894 MHz, 2010-2020 MHz, 3300-3380 MHz (n78), 4800-5000 MHz (n79), 5150-5925 MHz (TDD-LTE B46) |
| State 4 | 4.3 nH | 0.7 pf | On, 8 pf | 824-863 MHz, 3300-3380 MHz (n78), 4800-5000 MHz (n79), 5150-5925 MHz (TDD-LTE B46) |
| State 5 | 6.2 nH | 0.5 pf | On, 8 pf | 791-832 MHz, 3300-3380 MHz (n78), 4800-5000 MHz (n79), 5150-5925 MHz (TDD-LTE B46) |
| State 6 | 6.2 nH | 0.8 pf | On, 8 pf | 740-803 MHz, 3300-3380 MHz (n78), 4800-5000 MHz (n79), 5150-5925 MHz (TDD-LTE B46) |
| State 7 | 6.2 nH | 1.2 pf | On, 8 pf | 703-760 MHz, 3300-3380 MHz (n78), 4800-5000 MHz (n79), 5150-5925 MHz (TDD-LTE B46) |
| State 8 | Open | 0.3 pf | On, 8 pf | 1710-2690 MHz, 3300-3380 MHz (n78), 4800-5000 MHz (n79), 5150-5925 MHz (TDD-LTE B46) |

Figure 7:
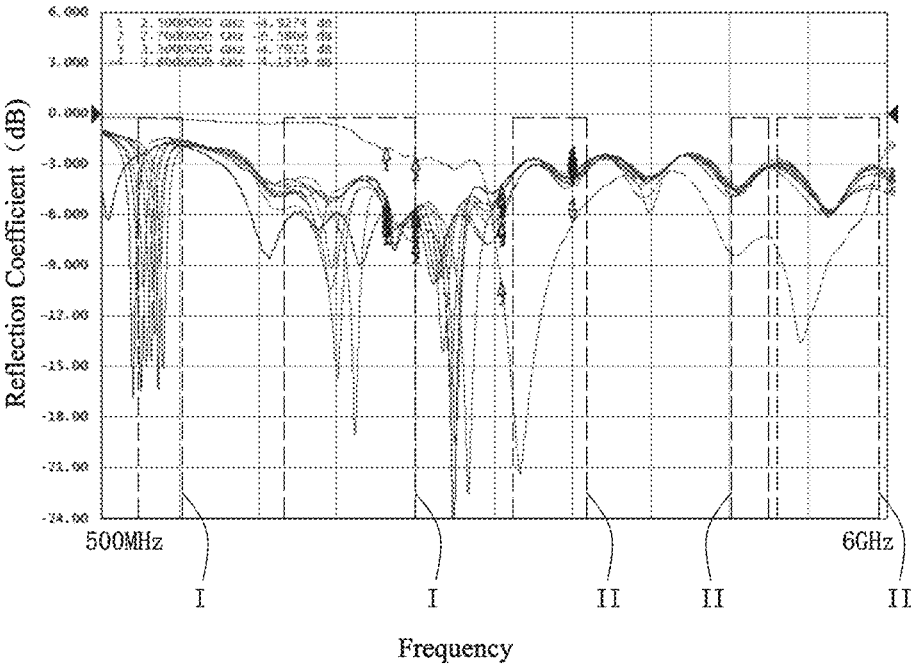
FIG. 7 illustrates a simulation effect graph of return loss of an antenna module of a mobile terminal provided by the present disclosure when a second tuning switch is in a second mode.
Figure 8:
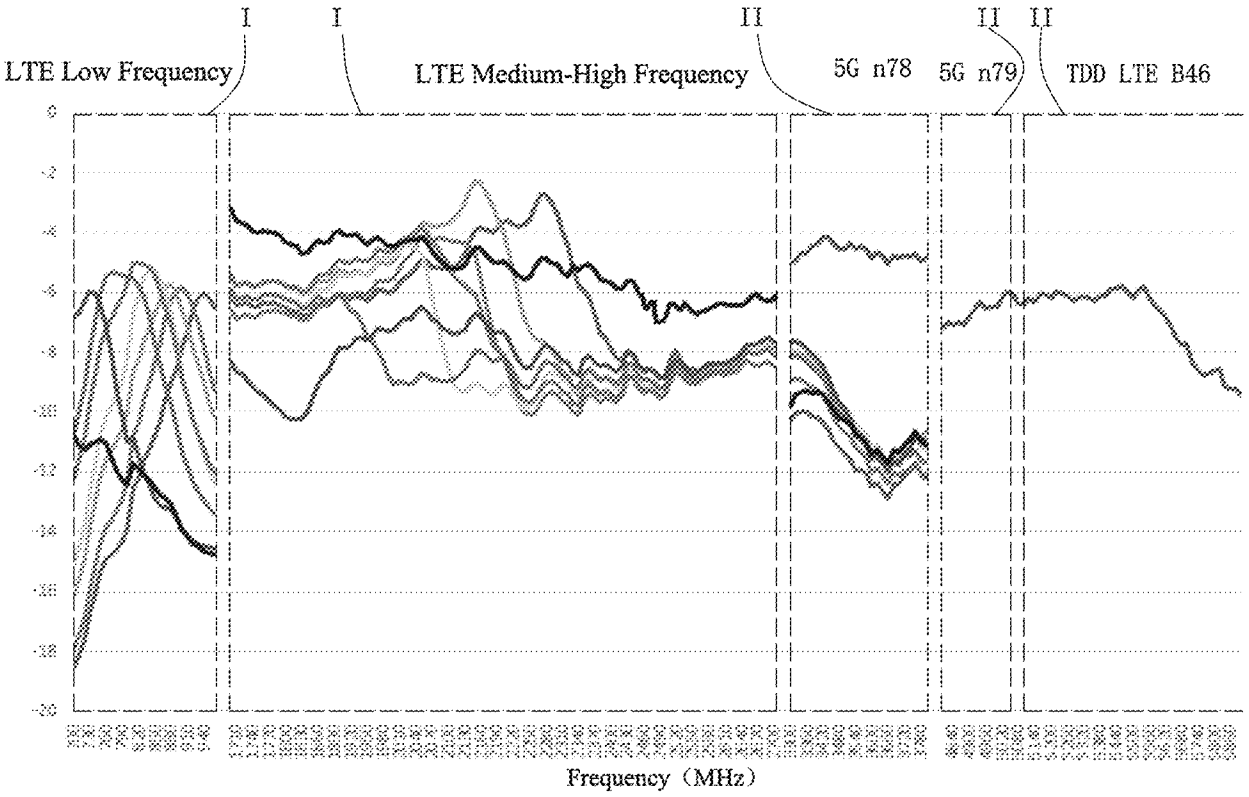
FIG. 8 illustrates a simulation effect graph of radiation efficiency of an antenna module of a mobile terminal provided by the present disclosure when a second tuning switch is in a second mode.

As can be seen from the above table, the second antenna always supports bands of n78 (3300-3380 MHz), n79 (4800-5000 MHz) and B46 (5150-5925 MHz) regardless of the state of the first antenna. Referring to FIG. 7 and FIG. 8 in conjunction, the I region in FIG. 7 and FIG. 8 illustrates a simulation result of the return loss of the first antenna in the eight states in the above table, and the II region illustrates a simulation result of the return loss of the second antenna. It can also be seen from FIG. 7 and FIG. 8 that when the first antenna is switched between State 1 through State 8, the second antenna always supports bands of n78 (3300-3380 MHz), n79 (4800-5000 MHz) and B46 (5150-5925 MHz).

Figure 9:
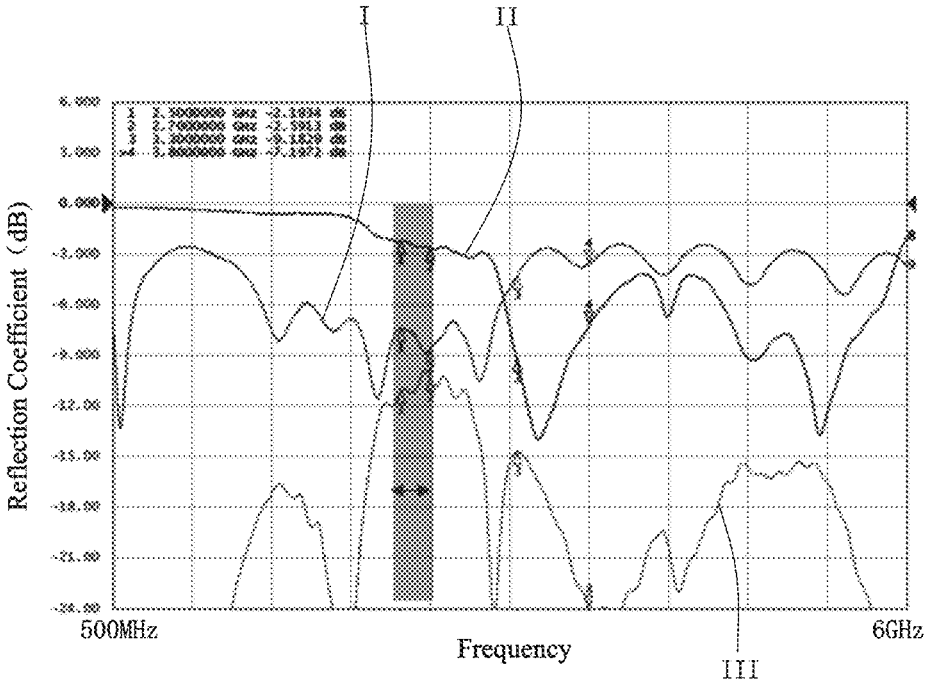
FIG. 9 illustrates a graph of reflection coefficients and isolation of an antenna module of a mobile terminal provided by the present disclosure when a second tuning switch is in a second mode.

Referring to FIG. 9. FIG. 9 illustrates a simulation effect graph of the performance of an antenna module of a mobile terminal provided by the present disclosure when the second tuning switch is in a second mode and the first antenna is in State 8. As can be seen from FIG. 9, in State 8, the isolation of the first antenna to the second antenna in the band of B7/B38/B41 (2.5-2.69 GHz) is poor, and although the performance of the first antenna in this band can also support the combination use of multi-carrier aggregation, the antenna performance needs to be optimized when using this band alone.

Figure 10:
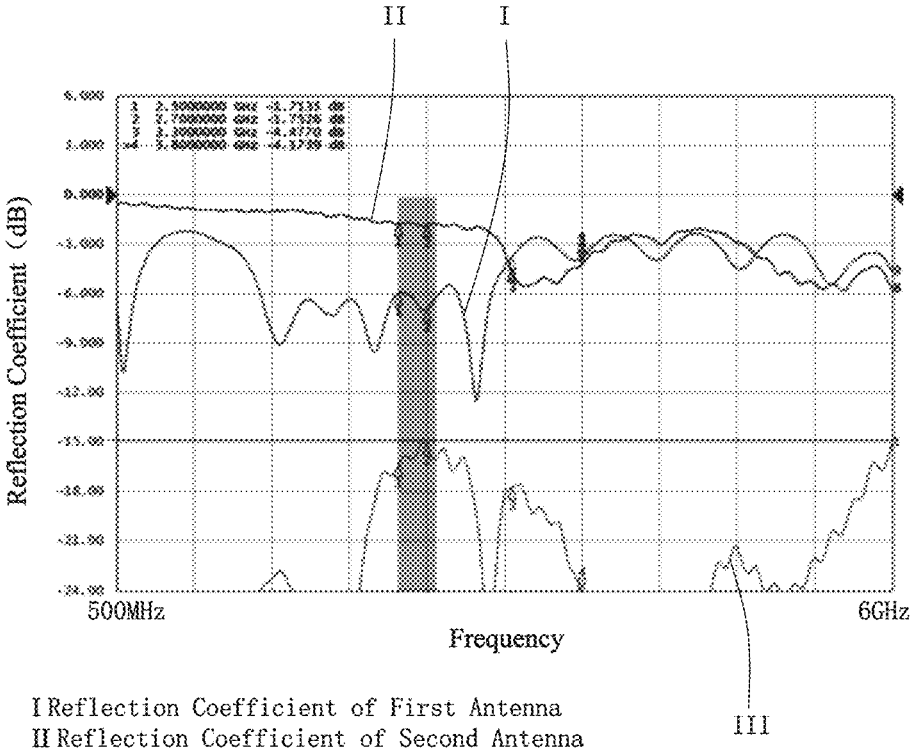
FIG. 10 illustrates a graph of reflection coefficients and isolation of an antenna module of a mobile terminal provided by the present disclosure when a second tuning switch is in a first mode.
Figure 11:
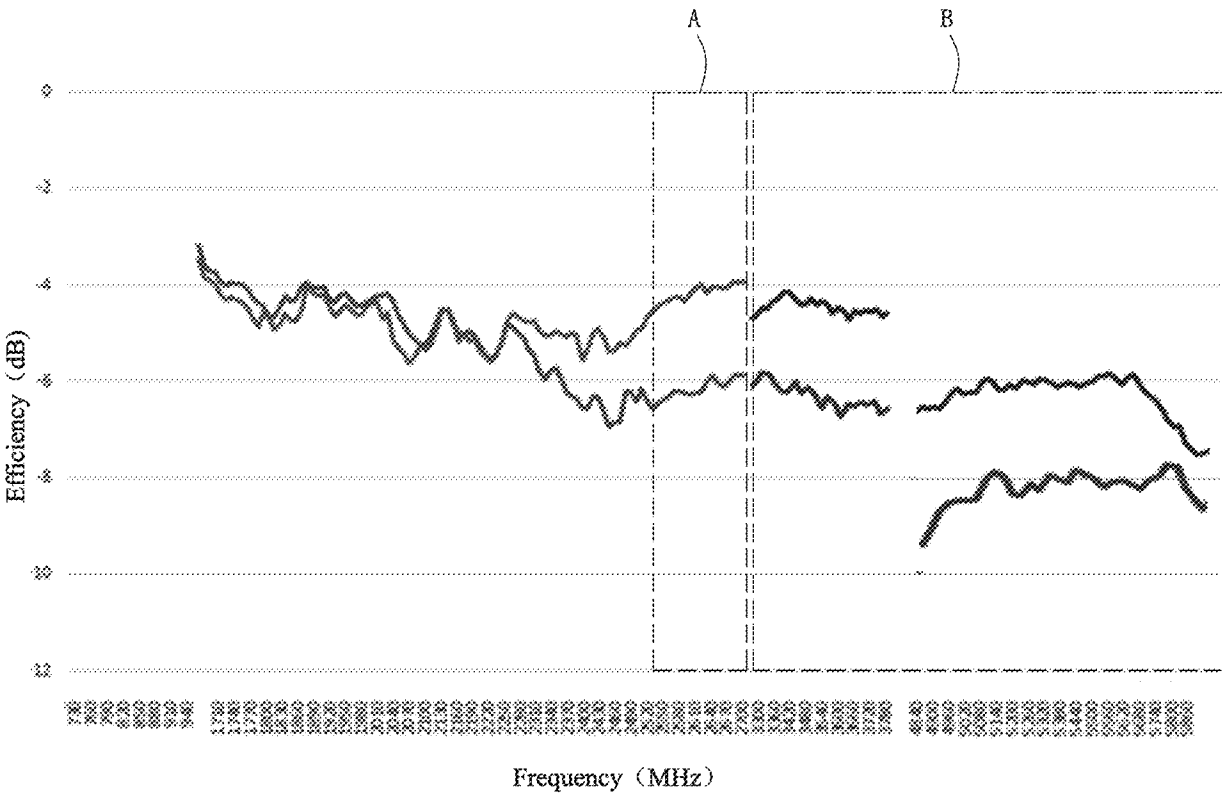
FIG. 11 illustrates a performance comparison before and after isolation of an antenna module of a mobile terminal provided by the present disclosure is improved.

FIG. 10 and FIG. 11 illustrates a simulation effect graph of the performance of an antenna module when the second tuning switch is in a first mode and the first antenna is in State 8. It can be seen from FIG. 10 that by causing the isolation circuit to access to the feeding network, the isolation of the first antenna to the second antenna in the band of B7/B38/B41 (2.5-2.69 GHz) is improved. It can be seen from the region A in FIG. 11 that, after the isolation is improved, the efficiency of the first antenna is improved by about 2 dB (the upper curve of the two curves is for the case after improvement, and the lower curve is for the case before improvement). It can be seen from the B region that the efficiency of the second antenna is reduced after the isolation is improved, but it can still support bands of n78 (3300-3380 MHz), n79 (4800-5000 MHz) and B46 (5150-5925 MHz) (the upper curve of the two curves is for the case before improvement, and the lower curve is for the case after improvement).

It can be seen from FIG. 10 and FIG. 11 that when the isolation circuit accesses to the feeding network of the second antenna, the performance of the first antenna in the band of B7/B38/B41 (2.5-2.69 GHz) will increase. Therefore, when the first antenna is to use the band of B7/B38/B41 alone, the isolation circuit can access to the feeding network of the second antenna to achieve better performance in the band of B7/B38/B41.

The antenna module provided by the present disclosure includes a first antenna and a second antenna close to the first antenna. The second antenna includes an isolation circuit and a second tuning switch that controls an access state of the isolation circuit, and the second tuning switch includes two modes. When the second tuning switch is in a first mode, the isolation circuit accesses to a feeding network of the second antenna, and when the second tuning switch is in a second mode, the isolation circuit does not access to the feeding network of the second antenna. The isolation of the first antenna to the second antenna in the preset band in the first mode is superior to that in the second mode. Through the switching between two modes of the second tuning switch, the isolation circuit accesses to the feeding network so as to improve the isolation of the preset band of B7/B38/B41 (2.5~2.69 GHz), and improve the antenna performance in this band.

What have been described above are only embodiments of the present disclosure, and it should be noted herein that one ordinary person skilled in the art can make improvements without departing from the inventive concept of the present disclosure, but these are all within the scope of the present disclosure.

What is claimed is:

1. An antenna module, comprising:

a first antenna, and a second antenna close to the first antenna, the second antenna comprising an isolation circuit and a second tuning switch configured to control a connected-state of the isolation circuit, wherein the second tuning switch includes two modes, when the second tuning switch is in a first mode, the isolation circuit is connected in a feeding network of the second antenna, and when the second tuning switch is in a second mode, the isolation circuit is not connected in the feeding network of the second antenna; and wherein isolation of the first antenna to the second antenna in a preset band in the first mode is superior to isolation of the first antenna to the second antenna in the second mode.

2. The antenna module as described in claim 1, wherein in the first mode and the second mode, the first antenna and the second antenna form a 2×2 MIMO of 5G bands of 3300-3800 MHz and 4800-5000 MHz.

3. The antenna module as described in claim 2, wherein in the second mode, the first antenna supports an LTE low frequency of 698-960 MHz and an LTE medium-high frequency of 1710-2690 MHz, and supports multi-carrier aggregation.

4. The antenna module as described in claim 2, wherein in the first mode and the second mode, the second antenna further supports a new TDD-LTE band of 5150-5925 MHz.

5. The antenna module as described in claim 1, wherein the preset band is 2500-2690 MHz.

6. The antenna module as described in claim 1, wherein the feeding network of the second antenna further comprises a second variable capacitor, and in the first mode and the second mode, the second variable capacitor is connected in the feeding network of the second antenna with different capacitance values.

7. The antenna module as described in claim 6, wherein the antenna module is applied to a mobile terminal, and the mobile terminal comprises a metal frame, a main board received in the metal frame, and a plastic bracket provided on and covering the main board;

the metal frame comprises two middle frames arranged opposite to each other and a bottom frame connecting the two middle frames, the bottom frame is provided with a first slit and a second slit, the first slit and the second slit separate the bottom frame into a main frame located in a middle position and a left-side connecting frame and a right-side connecting frame that are provided on two sides of the main frame;

the antenna module comprises a first feeding point, a second feeding point, a first ground point, a second ground point, a first variable capacitor, a first tuning switch, and the feeding network that are provided on the main board, and a first antenna unit and a second antenna unit that are provided on a surface of the plastic bracket facing away from the main board, the first feeding point is connected at a first position of the main frame, the second feeding point is connected at a second position of the right-side connecting frame, and the first position and the second position are both provided close to the second slit;

the main frame, the first antenna unit and the second antenna unit form a first radiation portion, one end of the first antenna unit is connected to the first feeding point and the other end thereof is connected to the main frame, the main frame is connected to the first ground point through the first tuning switch, one end of the second antenna unit is connected to the main frame and the other end thereof is connected to the second ground point through the first variable capacitor, so as to form a first antenna;

the right-side connecting frame is a second radiation portion, the second radiation portion is grounded through one of the two middle frames connected thereto, and the second feeding point is connected to the second radiation portion through the feeding network, so as to form a second antenna;

the feeding network comprises the second variable capacitor and a matching network, the matching network comprises a first branch and a second branch connected in series, a first end of the second variable capacitor is connected to the second feeding point, a second end of the second variable capacitor is respectively connected to a first end of the first branch and the second radiation portion, a second end of the first branch is grounded through the second branch, the first branch comprises the second tuning switch having an open-circuit state and a short-circuit state and the isolation circuit connected in parallel to the second tuning switch.

8. The antenna module as described in claim 7, wherein the isolation circuit comprises a first capacitor and a first inductor connected in parallel.

9. The antenna module as described in claim 7, wherein the first ground point is connected at a third position of the main frame, the second ground point is connected at a fourth position of the main frame, and the mobile terminal further comprises a USB module, the third position and the fourth position are respectively provided on two sides of the USB module, and the third position is located between the USB module and the first position.

10. A mobile terminal, comprising the antenna module as described in claim 1.

* * * * *